US008881804B2

(12) United States Patent
Kang et al.

(10) Patent No.: US 8,881,804 B2
(45) Date of Patent: Nov. 11, 2014

(54) EXPANDABLE SCREEN BY SPRING FORCE

(71) Applicant: Halliburton Energy Services, Inc, Houston, TX (US)

(72) Inventors: James Jun Kang, Dallas, TX (US); Aaron James Bonner, Flower Mound, TX (US); Michael Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/038,745

(22) Filed: Sep. 26, 2013

(65) Prior Publication Data

US 2014/0076540 A1 Mar. 20, 2014

Related U.S. Application Data

(63) Continuation of application No. PCT/US2012/056161, filed on Sep. 19, 2012.

(51) Int. Cl.

| | |
|---|---|
| ***E21B 43/10*** | (2006.01) |
| ***E21B 23/03*** | (2006.01) |
| ***E21B 43/08*** | (2006.01) |

(52) U.S. Cl.

CPC ..... *E21B 43/08* (2013.01); *E21B 43/103* (2013.01)

USPC ..... 166/227; 166/100

(58) Field of Classification Search

USPC ..... 166/227, 100

See application file for complete search history.

(56) References Cited

U.S. PATENT DOCUMENTS

| | | | | |
|---|---|---|---|---|
| 3,099,318 | A * | 7/1963 | Miller et al. | 166/227 |
| 3,390,724 | A | 7/1968 | Caldwell | |
| 7,703,508 | B2 * | 4/2010 | Orban | 166/105.1 |
| 2007/0012444 | A1 | 1/2007 | Horgan et al. | |
| 2007/0131434 | A1 | 6/2007 | MacDougall et al. | |
| 2008/0149351 | A1 * | 6/2008 | Marya et al. | 166/387 |
| 2008/0308274 | A1 | 12/2008 | MacDougall et al. | |
| 2009/0065199 | A1 | 3/2009 | Patel et al. | |
| 2010/0051262 | A1 | 3/2010 | Dusterhoft et al. | |
| 2010/0051270 | A1 * | 3/2010 | Dusterhoft et al. | 166/278 |
| 2014/0076540 | A1 | 3/2014 | Kang et al. | |
| 2014/0083720 | A1 * | 3/2014 | Kang et al. | 166/381 |

FOREIGN PATENT DOCUMENTS

WO 2014046653 A1 3/2014

OTHER PUBLICATIONS

Foreign Communication from a Related Counterpart Application, "International Search Report and Written Opinion" dated Apr. 8, 2013, International Application No. PCT/US12/56161 filed on Sep. 19, 2012.

FAIPP Pre-Interview Communication dated Aug. 11, 2014, filed on Sep. 25, 2013, U.S. Appl. No. 14/007,639.

* cited by examiner

*Primary Examiner* — Giovanna Wright

(57) ABSTRACT

A sand control screen assembly selectively positionable within a wellbore. The sand control screen assembly comprises a pipe having an internal flow path, an external fluid collection subassembly in fluid communication with the internal flow path, a filter medium disposed in a fluid path between the exterior of the sand control screen assembly and the internal flow path, a biasing mechanism, configured to bias the fluid collection subassembly towards a wall of the wellbore, disposed between the fluid collection subassembly and the pipe, and a retaining mechanism configured to release the biasing mechanism in response to a trigger.

20 Claims, 10 Drawing Sheets

EXPANDABLE SCREEN BY SPRING FORCE

CROSS-REFERENCE TO RELATED APPLICATIONS

This application is a continuation of and claims priority to International Application No. PCT/US12/56161, filed Sep. 19, 2012, entitled "EXPANDABLE SCREEN BY SPRING FORCE," which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine sand that may cause numerous problems. Formation sand may erode production components in the flow path or clog the well creating the need for a workover. If particulate materials are produced to the surface, then they must be removed from the hydrocarbon fluids. In some completions, the wellbore is uncased, and an open face is established across the oil or gas bearing zone. Such open bore hole (uncased) arrangements are typically utilized, for example, in water wells, test wells, and horizontal well completions.

When formation sand is expected to be encountered, one or more sand screens can be installed in the flow path between the production tubing and the perforated casing (cased) and/or the open well bore face (uncased). A packer is customarily set above the sand screen to seal off the annulus in the zone where production fluids flow into the production tubing. The annulus around the screen can then be packed with a relatively coarse sand (or gravel) which acts as a filter to reduce the amount of fine formation sand reaching the screen and as a support to reduce the local tensile stresses in the formation which can lead to sand production. The packing sand is pumped down the work string in a slurry of water and/or gel and fills the annulus between the sand screen and the well casing. In well installations in which the screen is suspended in an uncased open bore, the sand or gravel pack may serve to support the surrounding unconsolidated formation.

During the sand packing process, annular sand "bridges" can form around the sand screen that may prevent the complete circumscribing of the screen structure with packing sand in the completed well. This incomplete screen structure coverage by the packing sand may leave an axial portion of the sand screen exposed to the fine formation sand, thereby undesirably lowering the overall filtering efficiency of the sand screen structure.

SUMMARY

In an embodiment, a sand control screen assembly is disclosed. The sand control screen assembly comprises a pipe comprising an internal flow path. The sand control screen assembly further comprises a fluid collection subassembly disposed externally to the pipe and in fluid communication with the internal flow path. A filter medium is disposed in a fluid path between an exterior of the sand control screen assembly and the internal flow path. The sand control screen assembly further comprises a biasing mechanism which is configured to bias the fluid collection subassembly towards a wall of the wellbore and is disposed between the fluid collection subassembly and the pipe. The sand control screen assembly also comprises a retaining mechanism configured to release the biasing mechanism in response to a trigger.

In another embodiment, a second sand control screen assembly is disclosed. The second sand control screen assembly comprises a pipe comprising at least one opening in a sidewall portion and an internal flow path. A filter medium is placed in a fluid path between an exterior of the second sand control screen assembly and the internal flow path. The second sand control screen assembly further comprises a biasing mechanism between the filter medium and the pipe and a retaining mechanism configured to release the biasing mechanism in response to a trigger. The biasing mechanism is configured to bias the filter medium towards a wall of the wellbore when released.

In another embodiment, a method of installing a sand control screen assembly is disclosed. The method comprises positioning the sand control assembly within a wellbore, triggering a biasing mechanism, releasing stored mechanical energy in response to the triggering, and biasing a filter medium towards a wall of the wellbore after the releasing. The sand control assembly comprises a pipe comprising an internal flow path, and a filter medium disposed in a fluid path between an exterior of the sand control screen assembly and the internal flow path.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE DRAWINGS

Figure 1A:
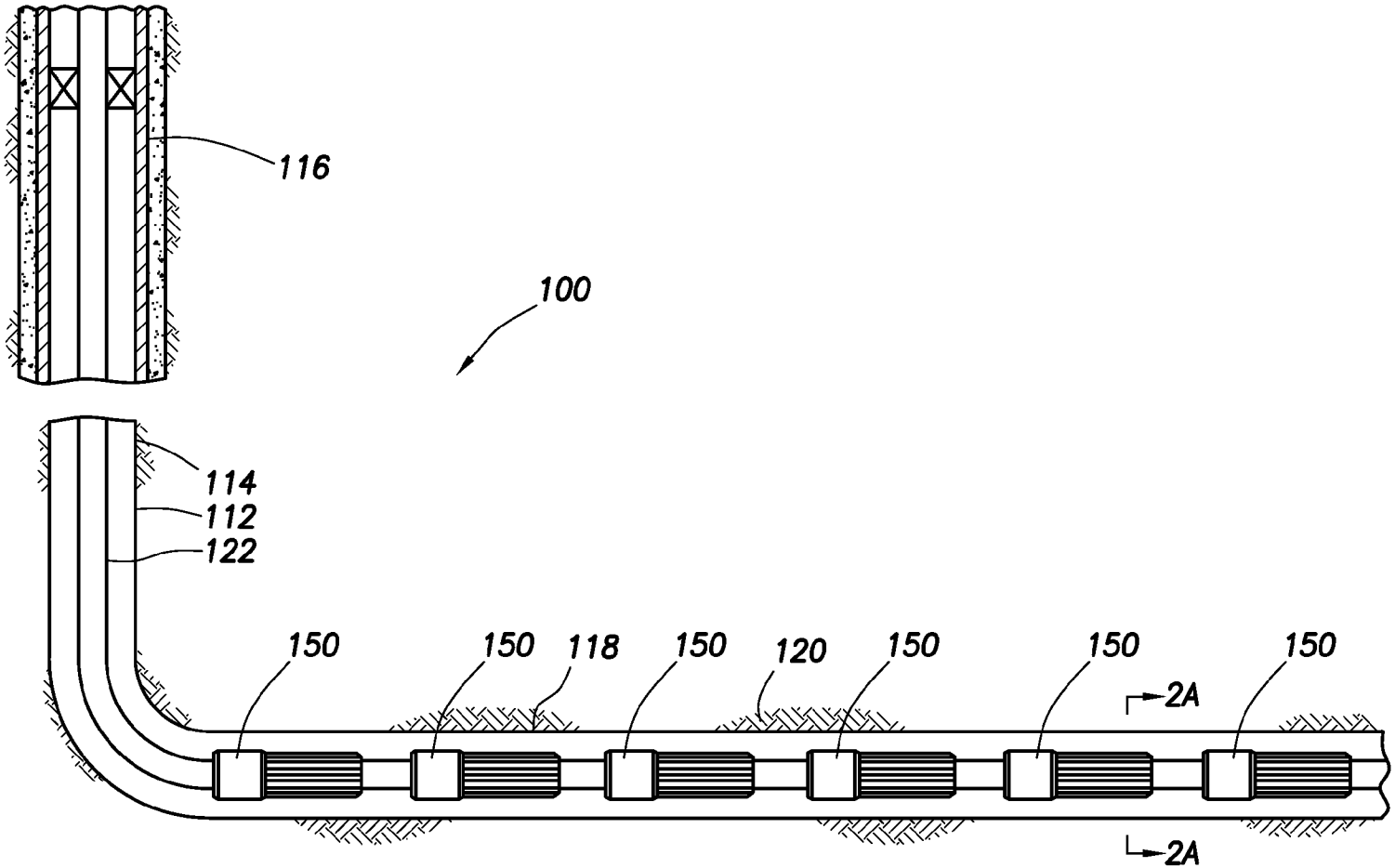
FIG. 1A is an illustration of a well system operating a plurality of sand control screen assemblies in a first configuration according to an embodiment of the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal," "longitudinally," "axial," or "axially" refers to an axis substantially aligned with the central axis of the wellbore, while tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

In an attempt to collect hydrocarbons, an oil and/or gas well may be drilled through a hydrocarbon bearing formation. In such a well, it may be beneficial to provide support to the wall of the well bore and to reduce the effects of fine particulate matter. Currently, swellable materials are used to expand and provide support to the wall of the wellbore. Swellable materials may be heavy, expensive, and may take a week or more to engage the wall of the wellbore. In some circumstances, it may be beneficial to reduce weight and/or to engage the wall of the wellbore as quickly as possible.

In an embodiment, a system configured to act to control the effects of fine particulate matter in a wellbore is taught. The system is in the form of a sand control screen assembly which comprises extendable fluid collection subassemblies in fluid communication with an internal flow path of a pipe and configured to prevent fine particulate matter from entering the flow path. The fluid collection subassemblies may be deployed by selective release of stored mechanical energy. In an embodiment, mechanical energy may be stored in a spring held in place by a retention device. The spring may be held in place until the sand control screen assembly is positioned in the desired location. Upon reaching the location, the mechanical energy stored in the spring may be released in response to a trigger, thus applying force to the fluid collection subassembly biasing it outward. In an embodiment, the fluid collection subassemblies are configured such that upon triggering the release of stored mechanical energy, they are biased outward to engage and support the wall of the wellbore. Further, the fluid collection subassemblies may comprise a mechanism configured to ensure that once the fluid collection subassemblies deploy, they remain deployed. The fluid collection subassemblies may also comprise a plurality of perforations configured to allow hydrocarbons to flow therethrough.

It is expected that the use of stored mechanical energy to bias the fluid collection subassemblies, and consequently a filter medium, may decrease the amount of time involved in deploying the fluid collection subassemblies to engage the wall of the wellbore. The above system may also be lighter than currently employed systems. It may also be the case that the system allows for substantial sand protection while reducing the need for a gravel pack operation.

Referring now to FIG. 1A, therein is depicted an exemplary well system 100 comprising a plurality of sand control screen assemblies. Well system 100 comprises a wellbore 112 which comprises a substantially vertical section 114 and a substantially horizontal section 118. The upper portion of the substantially vertical section 114 comprises a casing string 116 that has been cemented in place. The substantially horizontal section 118 is depicted as extending through a hydrocarbon bearing formation 120. A tubular string 122 extends from the surface and is positioned within wellbore 112. Positioned within tubular string 122 is a plurality of sand control screen assemblies 150. The sand control screen assemblies 150 are depicted in their un-deployed form.

Production of hydrocarbons may be accomplished by flowing fluid containing hydrocarbons from the formation 120 into the substantially horizontal section 118 and into the tubular string 122 through at least one of the sand control screen assemblies 150. The sand control screen assemblies 150 may be configured to filter fine particulate matter from the fluid containing hydrocarbons.

Although FIG. 1A depicts the sand control screen assemblies 150 in the open and uncased substantially horizontal section 118, it is to be understood that the sand control screen assemblies 150 may also be used in cased wellbores. In addition, even though FIG. 1A depicts the sand control screen assemblies 150 in the substantially horizontal section 118, it is also to be understood that the sand control screen assemblies 150 are equally suited for use in wellbores having other directional configurations including vertical wellbores, deviated wellbores, slanted wellbores, multilateral wellbores and the like.

Figure 1B:
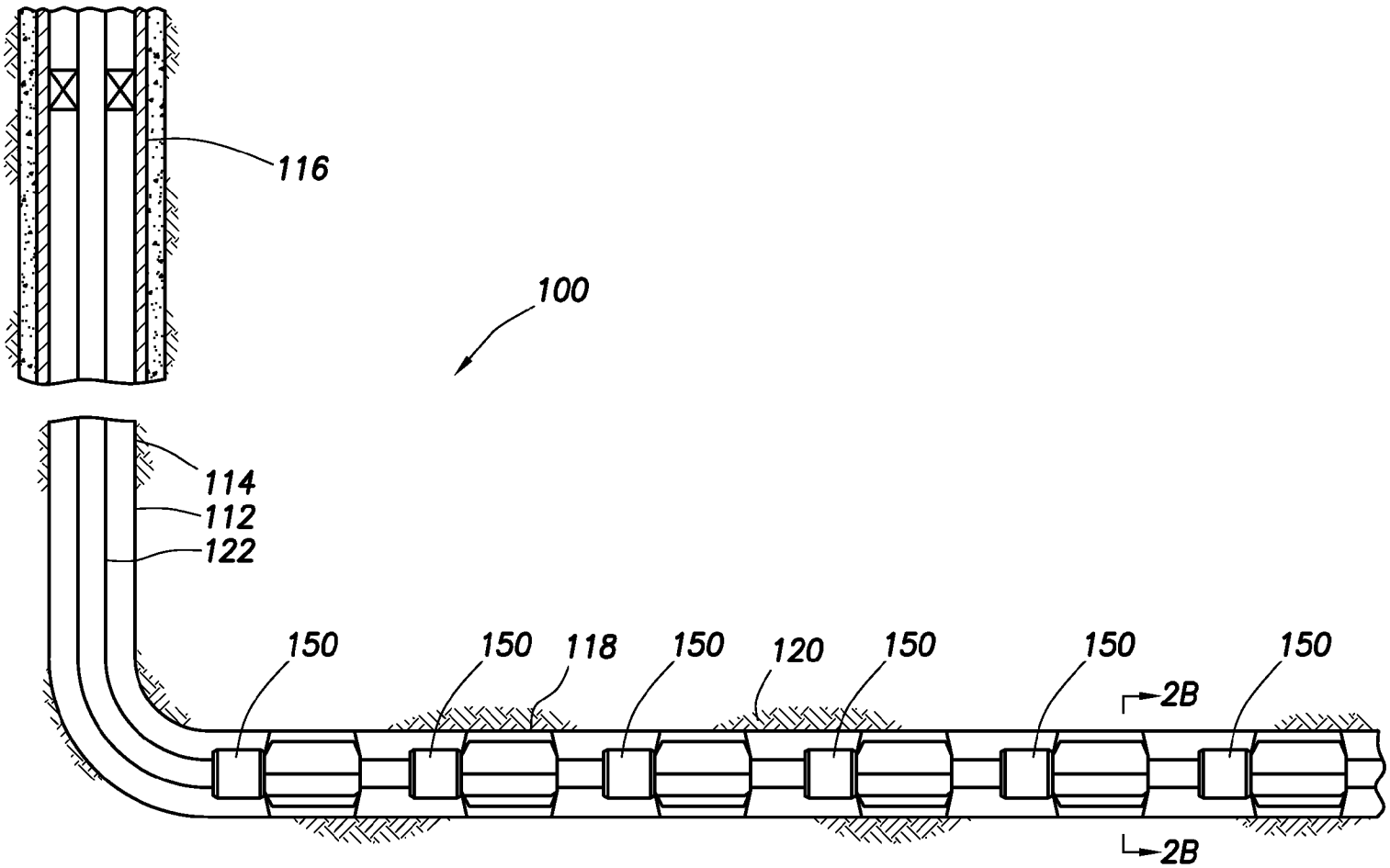
FIG. 1B is an illustration of a well system operating a plurality of sand control screen assemblies in a second configuration according to an embodiment of the disclosure.

Turning to FIG. 1B, therein is depicted the well system 100. FIG. 1B illustrates the sand control screen assemblies 150 in their deployed configuration. It should be noted that although FIG. 1B depicts the sand control screen assemblies 150 as contacting the wall of wellbore 112, the sand control screen assemblies 150 are suited to function in their extended configuration without such contact.

One skilled in the art will appreciate that although FIGS. 1A-1B depict the tubular string 122 as containing only the sand control screen assemblies 150, the tubular string 122 may comprise any number of other components. Further, the tubular string 122 may be divided into isolated zones through the use of one or more zonal isolation devices (e.g., packers).

Figure 2A:
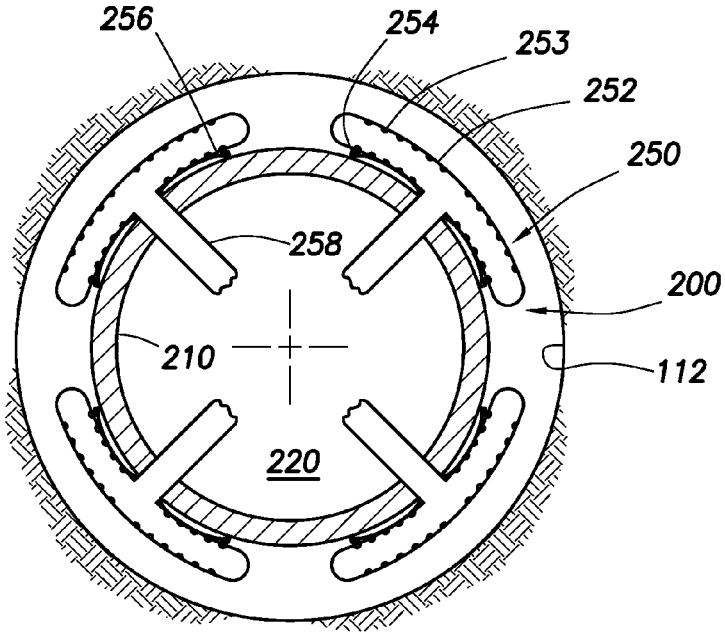
FIG. 2A is a cross-sectional view taken along line 2A-2A of a sand control screen assembly of FIG. 1A according to an embodiment of the disclosure.

Turning now to FIG. 2A, therein is depicted a cross-sectional view of a sand control screen assembly 200 in an un-deployed configuration positioned inside wellbore 112. The sand control screen assembly 200 comprises a pipe 210 with an internal flow path 220 disposed therethrough, a retention mechanism 254, a source of stored mechanical energy 256, and a fluid collection subassembly 250 which is in fluid communication with the internal flow path 220. The fluid collection subassembly 250 comprises a louver 252, a plurality of perforations 253 configured to allow hydrocarbons to flow therethrough, and a sliding member 258.

The pipe 210 may comprise openings configured to allow the sliding member 258 of the fluid collection subassembly 250 to pass therethrough. In an embodiment, the sliding member 258 of the fluid collection subassembly 250 may be disposed through one of the openings of the pipe 210. In this embodiment, the fluid collection subassembly 250 may be in fluid communication with the internal flow path 220 and may be extendable. To prevent sliding of the fluid collection subassembly 250, a sealing member (e.g., an O-ring) configured to provide friction to the sliding member 258, may be positioned in the opening. In an embodiment, the pipe 210 may be solid such that production fluids can only enter the internal flow path 220 through the fluid collection subassembly 250. In a different embodiment, the pipe 210 may comprise a plurality of perforations configured to allow production fluids to pass therethrough.

As discussed above, the fluid collection subassembly 250 may comprise the sliding member 258 disposed through a wall of the pipe 210. In an embodiment, the fluid collection subassembly 250 may comprise a plurality of sliding members 258 disposed through a plurality of openings in the pipe 210. In an embodiment, the fluid collection subassembly 250 may comprise a plurality of hollow sliding members 258, a plurality of solid sliding members 258, or both hollow and solid sliding members 258. The fluid collection subassembly may comprise a filter media configured to reduce the effects of fine particulate matter. The filter media may occur in the louver 252, in the sliding member 258, on the outer surface of the louver 252, or anywhere else that permits the reduction of the effects of fine particulate matter.

In an embodiment, the source of stored mechanical energy 256 may be in the form of at least one compressed spring. A variety of springs may be used. Suitable springs may include, but are not limited to, a bow spring, a coil spring, a volute spring, a gas spring, a torsion spring, a wave spring, polymeric material, coiled memory material, hydrostatic pressure acting on an air chamber, or other such method of storing mechanical energy capable of biasing the fluid collection subassembly 250. In an embodiment, the sliding member 258 may itself comprise a spring configured to bias the fluid collection subassembly 250 towards the wall of the wellbore 112. In an embodiment, at least one bow spring configured to bias the fluid collection subassembly 250 towards the wall of the wellbore 112 may be affixed longitudinally to the pipe 210. The bow spring may also be affixed to the pipe 210 in any other configuration that allows it to bias the fluid collection subassembly 250 towards the wall of the wellbore 112. In an embodiment, at least one coil spring configured to bias the fluid collection subassembly 250 towards the wall of the wellbore 112 may be affixed to the pipe 210. The coil spring may encircle the sliding member 258 such that the sliding member 258 passes through the center of the coil spring. In another embodiment, at least one coil spring may be placed on either side of the fluid collection subassembly 250. The coil springs may be affixed to the pipe 210 in any configuration that allows them to bias the fluid collection subassembly 250 towards the wall of the wellbore 112. As discussed in relation to bow and coil springs, any spring capable of biasing the fluid collection subassembly 250 towards the wall of the wellbore 112 may be affixed to the pipe 210 in any configuration that permits the biasing.

The spring may be retained by the retention mechanism 254 which may comprise a clip, a set screw, a plug, a clamp, a hose clamp or other such mechanism. It should be understood that the term set screw is not intended to limit the disclosure; rather it encompasses all manner of bolts, screws, pins, adhesives, etc. The retention mechanism 254 may retain the stored mechanical energy 256 directly or indirectly. In the case of a spring, the retention mechanism 254 may either retain the spring directly, or it may retain the spring indirectly by retaining the fluid collection subassembly 250. In retaining the stored mechanical energy 256 directly, the retention mechanism 254 may engage the source of the stored mechanical energy such that it is incapable of biasing the fluid collection subassembly 250 towards the wall of the wellbore 112. For example, in the case of a coil spring, the retention mechanism 254 may be a clamp that holds the spring in a compressed state thereby preventing it from biasing the fluid collection subassembly 250 towards the wall of the wellbore 112. In retaining the source of the stored mechanical energy 256 indirectly, the retaining mechanism may engage another component (e.g., the fluid collection subassembly 250) between the retaining mechanism 254 and the source of the stored mechanical energy 256. For example, the retention mechanism 254 may be a clamp configured to hold the fluid collection subassembly 250 in its un-deployed state thereby indirectly retaining the stored mechanical energy 256.

The retention mechanism 254 may be affixed to the pipe 210 in any manner that allows it to retain the stored mechanical energy 256. For example, the retention mechanism 254 may be affixed to the pipe 210 by a bonding agent, a set screw, etc. In an embodiment, the retention mechanism 254 may be a clamp, configured to retain the stored mechanical energy 256, affixed to the pipe by a bonding agent. The retention mechanism 254 may be configured to be triggered by any number of stimuli. For example, the retention mechanism 254 may be released by an electric stimulus, a magnetic stimulus, a thermal stimulus, a mechanical stimulus, a chemical stimulus, or combination thereof.

In some contexts, the fluid collection subassembly 250 may be said to be configured to be selectively triggered. In an embodiment, selective triggering may be accomplished by sending an electric signal from the surface to an electronic trigger mechanism downhole proximate to the retention mechanism 254, thus triggering the release of the stored mechanical energy 256. Triggering may be accomplished by an electronic timer, set at the surface, expiring and triggering the release of the stored mechanical energy 256.

Selective triggering may further be accomplished by pumping a fluid downhole to the sand control screen assembly 200 wherein the retention mechanism 254 may comprise a reactive material such as barium, sodium, manganese, chromium, iron, cobalt, nickel, zinc, aluminum, magnesium, calcium, tin, any alloy thereof, or any combination thereof. In some embodiments, the retention mechanism 254 may comprise various polymeric compounds configured to dissolve in the presence of a suitable fluid. The retention mechanism 254, comprising reactive material, may be designed to partially or wholly degrade upon exposure to a suitable fluid thereby releasing the stored mechanical energy 256. Dissolving a portion of the retention mechanism 254 may weaken the retention mechanism 254 such that it can no longer retain the stored mechanical energy 256. In an embodiment, the retention mechanism 254 may comprise a dissolvable portion configured to dissolve upon exposure to a suitable fluid. In this embodiment, the retention mechanism 254 may be configured to release the stored mechanical energy 256 once the dissolvable portion has dissolved. Similar embodiments involving dissolving different portions of the retention mechanism 254 in order to release the stored mechanical energy 256 are also contemplated.

In an embodiment, any fluid comprising a suitable chemical capable of dissolving at least a portion of the retention mechanism 254 may be used. In an embodiment, the chemical may comprise an acid, an acid generating component, a base, a base generating component, and any combination thereof. Examples of acids that may be suitable for use in the present invention include, but are not limited to organic acids (e.g., formic acids, acetic acids, carbonic acids, citric acids, glycolic acids, lactic acids, ethylenediaminetetraacetic acid (EDTA), hydroxyethyl ethylenediamine triacetic acid (HEDTA), and the like), inorganic acids (e.g., hydrochloric acid, hydrofluoric acid, nitric acid, sulfuric acid, phosphonic acid, p-toluenesulfonic acid, and the like), and combinations thereof. Examples of acid generating compounds may include, but are not limited to, polyamines, polyamides, polyesters, and the like that are capable of hydrolyzing or otherwise degrading to produce one or more acids in solution (e.g., a carboxylic acid, etc.). Examples of suitable bases may include, but are not limited to, sodium hydroxide, potassium carbonate, potassium hydroxide, sodium carbonate, and sodium bicarbonate. In some embodiments, additional suitable chemicals can include a chelating agent, an oxidizer, or any combination thereof. One of ordinary skill in the art with the benefit of this disclosure will recognize the suitability of the chemical used with the fluid to dissolve at least a portion of the retention mechanism 254 based on the composition of the retention mechanism 254 and the conditions within the wellbore.

In some embodiments, the retention mechanism 254 may comprise one or more coating layers used to isolate the retention mechanism 254 from the fluid until the coating is removed, thereby delaying the dissolution of the retention mechanism 254, thus delaying the subsequent release of the stored mechanical energy 256. In an embodiment, the coating may be disposed over at least a portion of the retention mechanism 254 exposed to fluid. The coating can be designed to disperse, dissolve, or otherwise permit contact between the retention mechanism 254 and the fluid when desired. The coating may comprise a paint, organic and/or inorganic polymers, oxidic coating, graphitic coating, elastomers, or any combination thereof which disperses, swells, dissolves and/or degrades either thermally, photo-chemically, bio-chemically and/or chemically, when contacted with a suitable stimulus, such as external heat and/or a solvent (such as aliphatic, cycloaliphatic, and/or aromatic hydrocarbons, etc.). In an embodiment, the coating may be configured to disperse, dissolve, or otherwise be removed upon contact with a chemical that is different than the fluid used to dissolve at least a portion of the retention mechanism 254. This may allow for one or more retention mechanisms to be selectively dissolved while other retention mechanisms comprising coatings remain un-dissolved.

The selection of the materials for the dissolvable portion of the retention mechanism 254, the chemical intended to at least partially dissolve the retention mechanism 254, and the optional inclusion of any coating may be used to determine the rate at which the retention mechanism 254, or at least a portion of the retention mechanism 254, dissolves. Further factors affecting the rate of dissolution include the characteristics of the wellbore environment including, temperature, pressure, flow characteristics around the retention mechanism 254, and the concentration of the chemical in the fluid in contact with the retention mechanism 254. These factors may be manipulated to provide a desired time delay before the retention mechanism 254 is dissolved.

Selective triggering may also be carried out by heat soaking the retention mechanism 254 in the downhole environment until the retention mechanism 254, which may be designed to have increased ductility when hot, yields and releases the stored mechanical energy 256. In an embodiment, the retention mechanism 254 may be a bonding agent that releases the stored mechanical energy 256 upon melting. Thermal insulation may be employed, based on the thermal profile of the well and/or the run in schedule, in order to ensure that the stored mechanical energy 256 is released at the proper time. Likewise, the thickness and/or composition of the retention mechanism 254 may be designed based on the thermal profile of the well and/or the run in schedule. In some embodiments, the retention mechanism can be a polymeric and/or composite material (e.g., a plastic material) that creeps under the applied force from the stored mechanical energy. The creep rate in the plastic retention mechanism may be increased by an increase in temperature, especially as the temperature approaches or exceeds the glass transition temperature of the material.

Figure 2B:
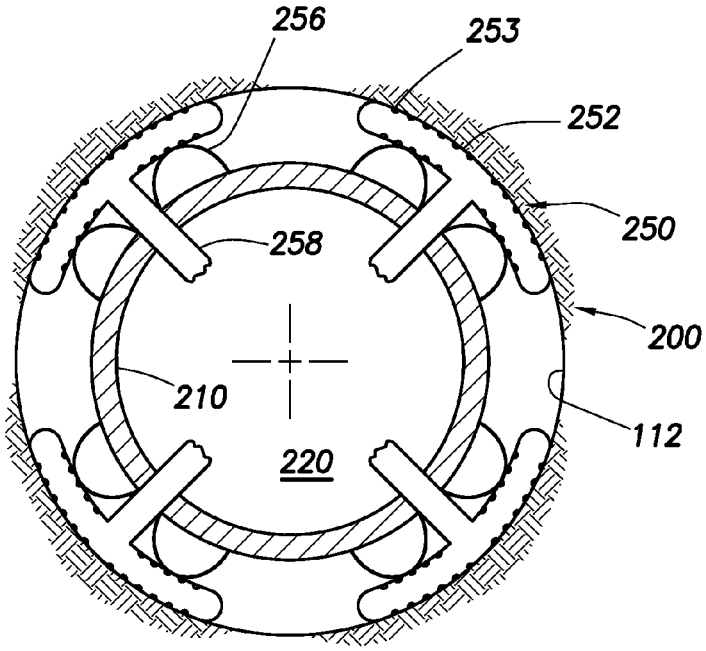
FIG. 2B is a cross-sectional view taken along line 2B-2B of a sand control screen assembly of FIG. 1B according to an embodiment of the disclosure.

Referring now to FIG. 2B, therein is depicted a cross-sectional view of the sand screen assembly 200 after the stored mechanical energy 256 has been released by the retention mechanism 254. FIG. 2B depicts the stored mechanical energy 256 biasing the louver 252 of the fluid collection subassembly 250 outwards toward the wall of wellbore 112. In an embodiment, the release of the stored mechanical energy 256 may be triggered by any of the above mentioned stimuli. In an embodiment, the retention mechanism 254 may comprise a reactive material such as barium, sodium, manganese, chromium, iron, cobalt, nickel, zinc, aluminum, magnesium, calcium, tin, alloys thereof, compositions thereof, or any combination thereof. Upon addition of a suitable fluid to the well system 100, the retention mechanism 254 may partially or wholly dissolve thereby triggering the release of the stored mechanical energy 256, thus biasing the fluid collection subassembly 250 towards the wall of wellbore 112. The same concept may be applied to electrical, thermal, mechanical and other triggers.

The sand control screen assembly 200 as depicted in FIG. 2B is configured to receive a flow of hydrocarbons and may provide support to wellbore 112. In an embodiment, the louver 252 may be in contact with wellbore 112, thus providing radial support to the wellbore 112 as hydrocarbons are extracted. In other embodiments, the louver 252 may not be in contact with wellbore 112, but still serves to provide a flow path for hydrocarbons while limiting and/or preventing the migration of fine particulate matter. FIGS. 2A-2B illustrate the louvers 252 with space between them, but certain embodiments may utilize the louvers in an overlapping fashion.

Figure 3:
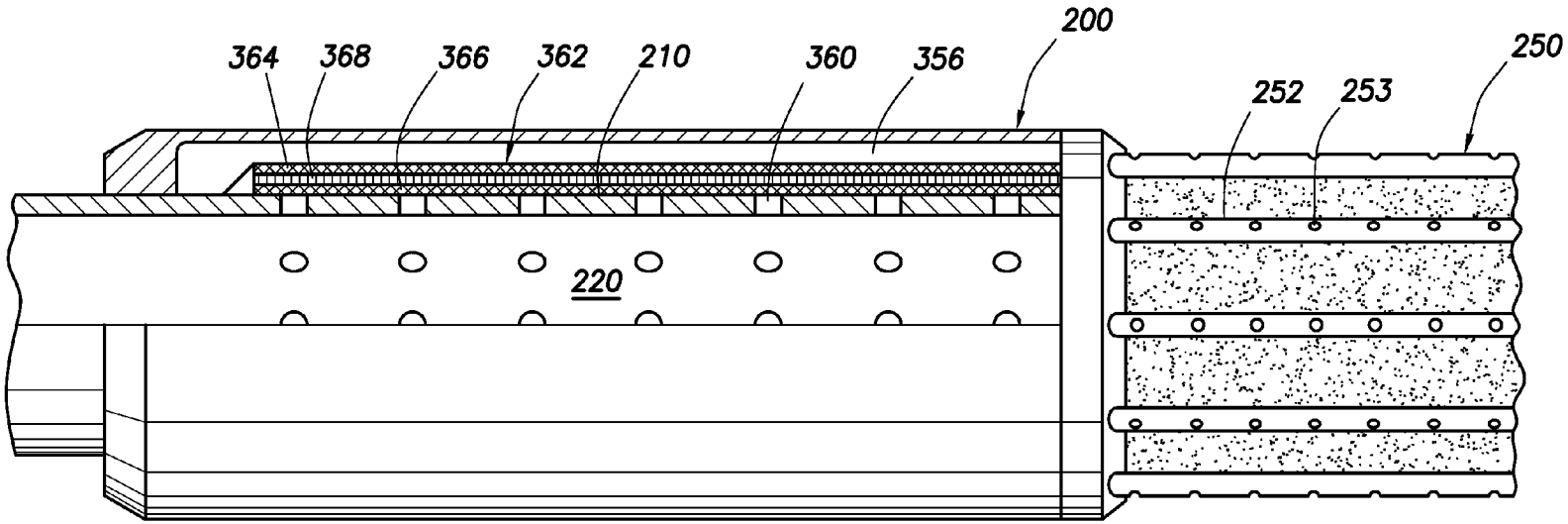
FIG. 3 is a side view partially in quarter section of a sand control screen assembly according to an embodiment of the disclosure.

FIG. 3 illustrates a plurality of fluid collection subassemblies 250 distributed circumferentially about the pipe 210. The fluid collection subassemblies 250 are shown as having the louver 252 and the perforations 253. The fluid collection subassemblies 250 are shown in an un-extended configuration; however, they may be extended outwards toward the wall of the wellbore. The pipe 210 contains a plurality of openings 360 that allow hydrocarbon bearing fluids to enter the internal flow path 220. A filter medium 362 is positioned between an annular space 356 and the pipe 210. The filter medium 362 is configured to permit the hydrocarbon bearing fluid to flow through while preventing the passage of sand and other fine particulate matter. FIG. 3 depicts the filter medium 362 as comprising a fine filtration layer 368 placed between an outer drainage layer 364 and an inner drainage layer 366.

The filter medium 362 is depicted as being disposed between the annular space 356 and the pipe 210, but it may also be disposed elsewhere. For example, the filter medium 362 may be disposed in the louvers 252 of the fluid collection subassembly 250, or it may be positioned in the sliding member 258 (see FIG. 2A-2B). The filter medium 362 may be configured to prevent the entry of sand or other fine particulate matter into the internal flow path 220. The filter medium 362 may function using any number of filtering mechanisms. For example, the filter medium 362 may comprise a wire wrap screen, a fine wire mesh configured to exclude particulate matter larger than a selected size, a prepack screen, a ceramic screen, metallic beads, or any combination thereof.

Figure 4A:
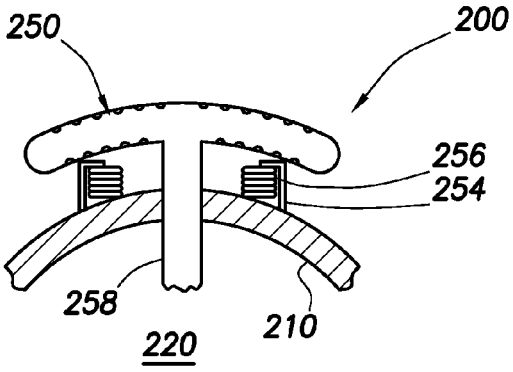
FIG. 4A is a cross-sectional view of a portion of a sand control screen assembly illustrating an extendable fluid collection subassembly in its first configuration according to an embodiment of the disclosure.

Turning now to FIG. 4A, therein is depicted a cross-sectional view of a portion of the sand control screen assembly 200. FIG. 4A illustrates an embodiment of the extendable fluid collection subassembly 250 in its non-deployed configuration. The fluid collection subassembly 250 extends through the pipe 210 and is in fluid communication with the internal flow path 220. The retention mechanism 254 retains the stored mechanical energy 256. In FIG. 4A, the stored mechanical energy 256 is provided by a pair of compressed springs and the retention mechanism 254 is depicted as a pair of clamps. The clamps may be of any design suitable to retain the springs. Further, the clamps may retain one side of the springs, or they may encircle the springs and retain their entire circumference. In an embodiment, the clamps are subject to the same triggering mechanisms as other embodiments of the retention mechanism 254 described above.

Figure 4B:
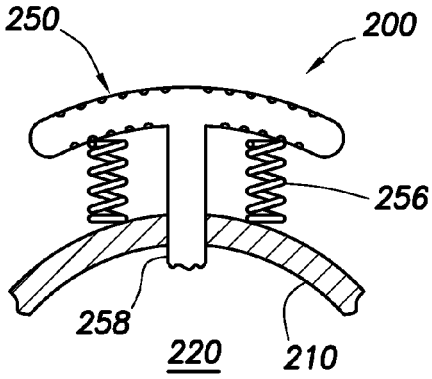
FIG. 4B is a cross-sectional view of a portion of a sand control screen assembly illustrating an extendable fluid collection subassembly in its second configuration according to an embodiment of the disclosure.

FIG. 4B depicts a cross-sectional view of a portion of the sand control screen assembly 200 after the retention mechanism 254 released the stored mechanical energy 256. FIG. 4B depicts the release of the stored mechanical energy 256 as being provided by the pair of extended springs. In this embodiment, the springs bias the fluid collection subassembly 250 away from the pipe 210.

Figure 5A:
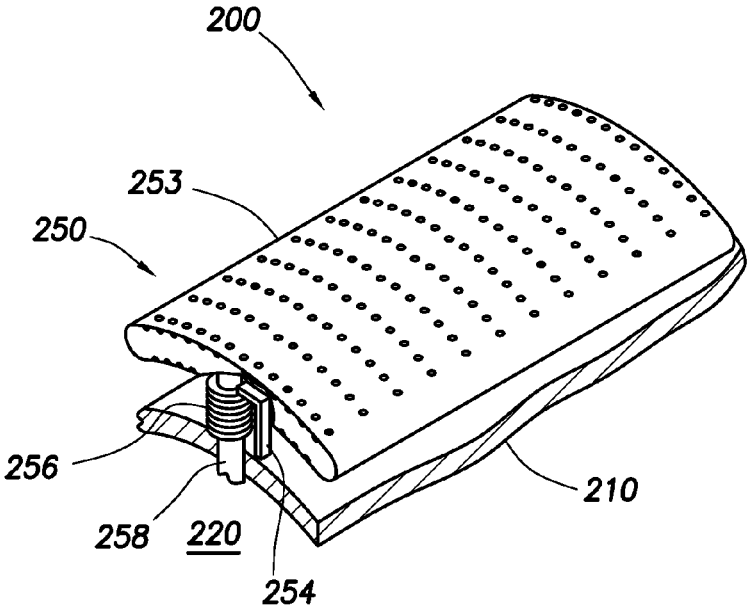
FIG. 5A is a diagonal view of a cross-section of a sand control screen assembly illustrating an extendable fluid collection subassembly in its first configuration according to an embodiment of the disclosure.

FIG. 5A illustrates a partial isometric view of a portion of the sand control screen assembly 200 in its un-deployed state. In this embodiment, the fluid collection subassembly 250 extends lengthwise along the pipe 210. The retention mechanism 254 retains the stored mechanical energy 256. FIG. 5A depicts the retention mechanism 254 as a clamp that retains stored mechanical energy 256 which is depicted as a spring that circumferentially surrounds the sliding member 258. The clamp may retain the spring at individual points, or it may retain the spring by encircling its entire circumference. As seen in FIG. 5A, the perforations 253 are shown extending along the fluid collection subassembly 250. The perforations 253 permit the passage of hydrocarbons through the fluid collection subassembly 250 and into the internal flow path 220.

Figure 5B:
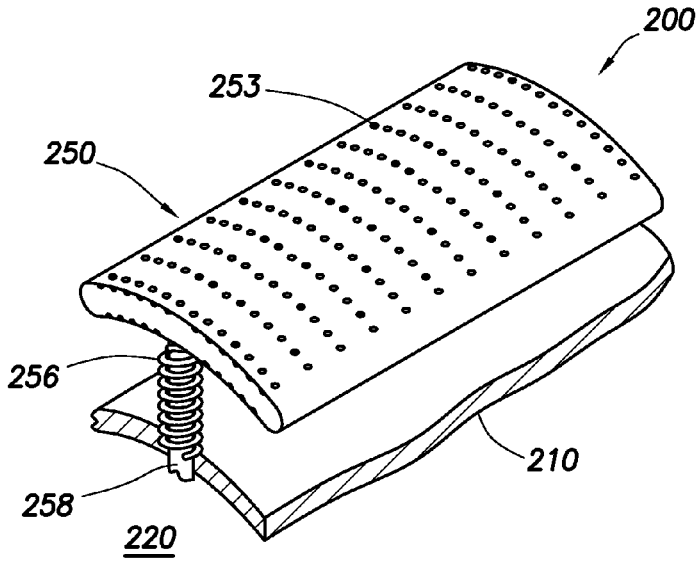
FIG. 5B is a diagonal view of a cross-section of a sand control screen assembly illustrating an extendable fluid collection subassembly in its second configuration according to an embodiment of the disclosure.

FIG. 5B illustrates a diagonal view of a cross-section of a portion of the sand control screen assembly 200 in its deployed state. FIG. 5B depicts the fluid collection subassembly 250 after the stored mechanical energy 256 has been released, thus biasing the fluid collection subassembly 250 away from the pipe 210.

Figure 6A:
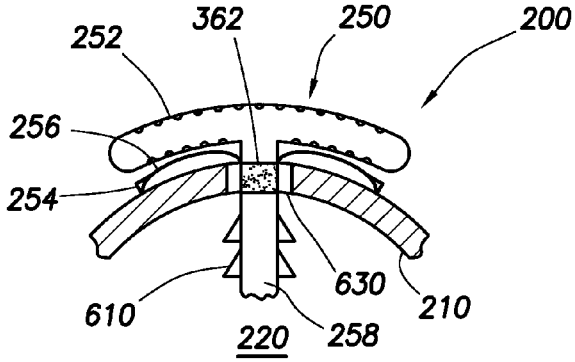
FIG. 6A is a cross-sectional view of a portion of a sand control screen assembly illustrating an extendable, locking fluid collection subassembly in its first configuration according to an embodiment of the disclosure.

Turning now to FIG. 6A, therein is depicted a cross-sectional view of a portion of the sand control screen assembly 200. FIG. 6A depicts the fluid collection subassembly 250 comprising the filter medium 362 disposed in a flow path in fluid communication with the internal flow path 220 of pipe 210 and a retraction prevention mechanism 610. A stop 630 is disposed in the pipe 210 and around the sliding member 258. The stop 630 and the retraction prevention mechanism 610 may be used to maintain the fluid collection subassembly 250 in an extended state. The retraction prevention mechanism 610 may be configured to prevent the fluid collection subassembly 250 from returning to its un-deployed position after the stored mechanical energy 256 has been released by the retention mechanism 254 and has biased the fluid collection subassembly 250 away from the pipe 210. In an embodiment, the retraction prevention mechanism 610 may comprise a ratchet and a wedge configured to prevent retraction of the fluid collection subassembly 250. Likewise, the stop 630 may be configured to prevent retraction of the fluid collection subassembly 250. In an embodiment, the stop 630 may be of a swellable material configured to swell thereby creating friction between itself and the fluid collection subassembly 250, thus preventing the fluid collection subassembly 250 from returning to its un-deployed state. The friction created by the stop 630 may be enhanced by adding a rough texture to the sliding member 258. FIG. 6A depicts the retraction prevention mechanism 610 as a ratchet and the stop 630 as a swellable plug; however, these components may comprise any number of devices.

Figure 6B:
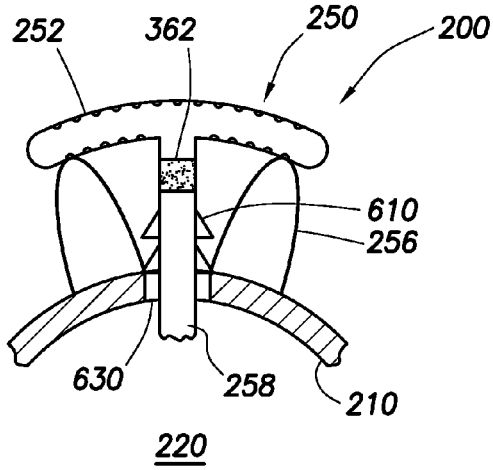
FIG. 6B is a cross-sectional view of a portion of a sand control screen assembly illustrating an extendable, locking fluid collection subassembly in its second configuration according to an embodiment of the disclosure.

FIG. 6B illustrates the fluid collection subassembly 250 in its deployed state. In this configuration, the fluid collection subassembly 250 has been biased away from the pipe 210. FIG. 6B shows the retraction prevention mechanism 610 as a ratchet and the stop 630 as a swellable plug. In FIG. 6B, the stored mechanical energy 256 has deployed the fluid collection subassembly 250 such that the ratchet has passed the outer wall of the pipe 210, thus preventing the fluid collection subassembly 250 from retracting to its un-deployed state. Further, the friction created by the swellable plug also prevents the fluid collection subassembly 250 from retracting to its un-deployed state. It should be noted, though the retraction prevention mechanism 610 and the stop 630 are depicted as functioning together, such association is not mandatory. The retraction prevention mechanism 610 and the stop 630 may function together, they may function independently, or they may function in the complete absence of the other. Different embodiments may include one, the other, or both the retraction prevention mechanism and the stop 630 which may function in a cooperative or independent manner.

Figure 7A:
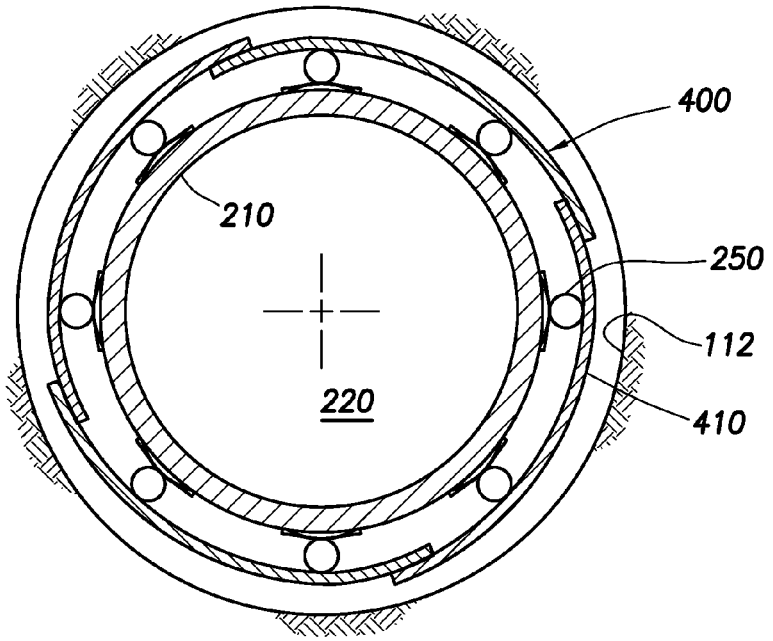
FIG. 7A is a cross sectional view of a portion of a sand control screen assembly illustrating an extendable screen in its first configuration according to an embodiment of the disclosure.

Turning now to FIG. 7A, therein is depicted a sand control screen assembly 400 in its running configuration. The sand control screen assembly 400 comprises the pipe 210, with the internal flow path 220 disposed therethrough, the fluid collection subassembly 250, and a screen element 410. It should be noted that although FIG. 7A depicts four screen elements 410, the sand control screen assembly 400 may comprise any number of screen elements 410. In the sand control screen assembly 400's running configuration, the screen elements 410 may be overlapping. Such a configuration may help to enable the screen element 410 to contact as much of the wellbore 112 as possible once the fluid collection subassembly 250 has been biased outward.

Figure 7B:
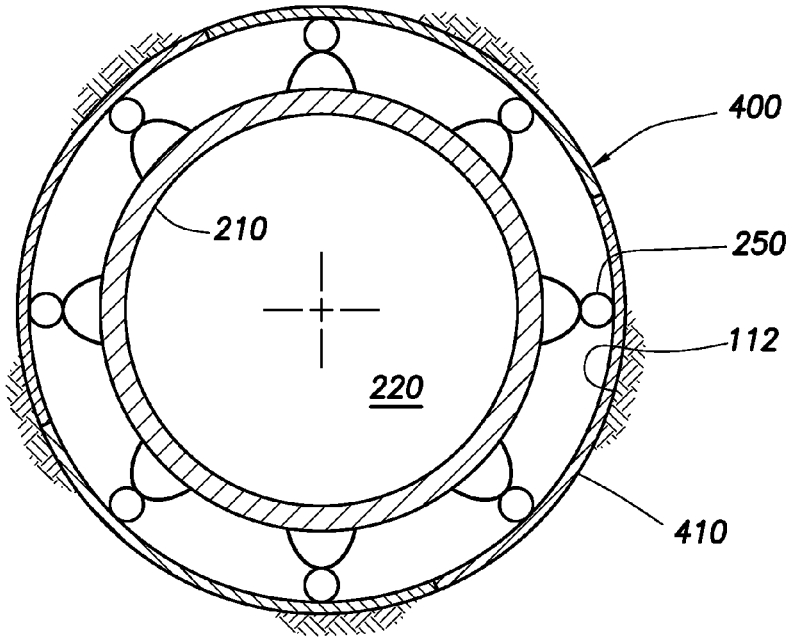
FIG. 7B is a cross sectional view of a portion of a sand control screen assembly illustrating an extendable screen in its second configuration according to an embodiment of the disclosure.

FIG. 7B illustrates the sand control screen assembly 400 in its operating configuration. As shown, the screen element 410 has been biased outward towards the wall of the wellbore 112. In such a configuration, the screen element 410 may provide support to the wall of the wellbore 112 and may aid in preventing formation collapse. In the sand control screen assembly 400's operating configuration, the screen elements 410 may form a continuous screen, as seen in FIG. 7B, or they may remain overlapping. The screen element 410 may be used in conjunction with a filter medium to reduce the effects of fine particulate matter.

Figure 8A:
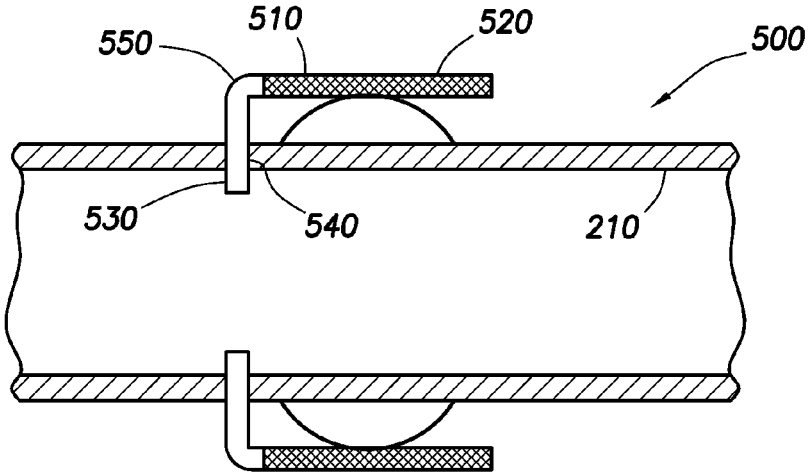
FIG. 8A is a cross sectional view of a portion of a sand control screen assembly according to an embodiment of the disclosure.
Figure 8B:
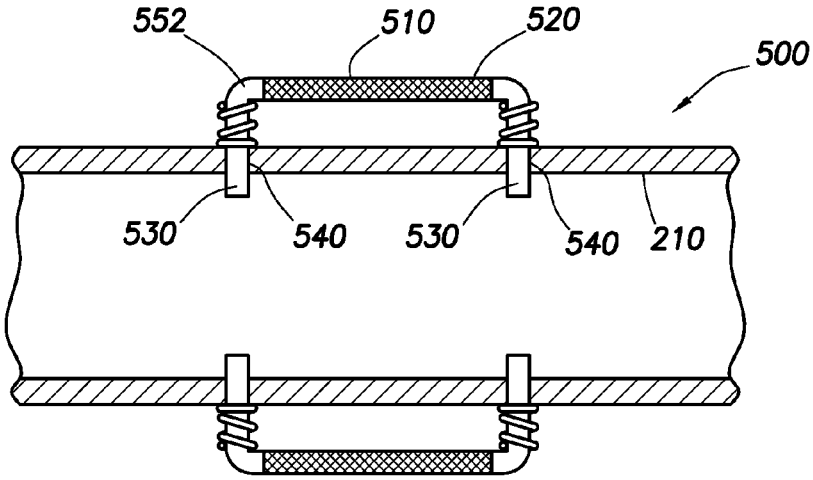
FIG. 8B is a cross sectional view of a portion of a sand control screen assembly according to an embodiment of the disclosure.
Figure 8C:
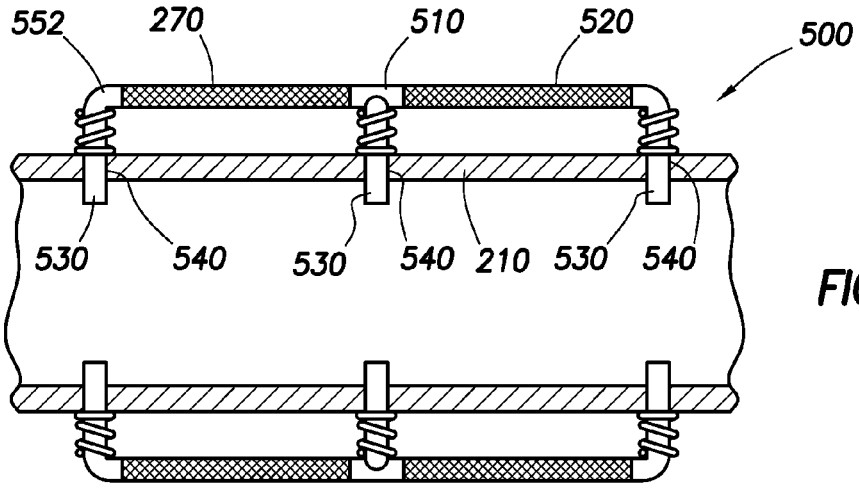
FIG. 8C is a cross sectional view of a portion of a sand control screen assembly according to an embodiment of the disclosure.

Even though the sand control screen assembly 200 has been described as having the louvers 252 formed in the shape of a 'T', those skilled in the art will recognize that other fluid inlets having other shapes could alternatively be used and would be considered within the scope of the present invention. For example, FIG. 8A illustrates a sand control screen assembly 500 comprising the pipe 210 and a plurality of sliding fluid inlets 550 formed in the shape of an "L". The sliding fluid inlets 550 may comprise a tubular member 510 having a plurality of perforations that are covered by a filter medium 520 and a discharge tube 530 that extends radially inward from the tubular member 510 through an opening 540 of pipe 210. FIG. 8B illustrates another embodiment of the sand control screen assembly 500. In this embodiment, the sand control screen assembly 500 comprises the pipe 210 and a plurality of sliding fluid inlets 552 formed in the shape of a "U". The sliding fluid inlets 552 may comprise the tubular member 510 having a plurality of perforations that are covered by a filter medium 520 and a pair of discharge tubes 530 that extend radially inwardly from the tubular member 510 through a pair of openings 540 of pipe 210. Further, as best seen in FIG. 8C, the sand control screen assembly 500 may comprise the pipe 210 and a plurality of sliding fluid inlets 554 formed in the shape of an "M". The sliding fluid inlets 554 may comprise a tubular member 510 having a plurality of perforations that are covered by a pair of filter media 520 and three discharge tubes 530 that extend radially inward from the tubular member 510 through the openings 540 of the pipe 210. Accordingly, it can be seen that fluid inlets that provide one or more direct paths for formation fluids to enter an internal flow path of a pipe can take many shapes or configurations, each of which are considered to be within the scope of the present invention.

Figure 9A:
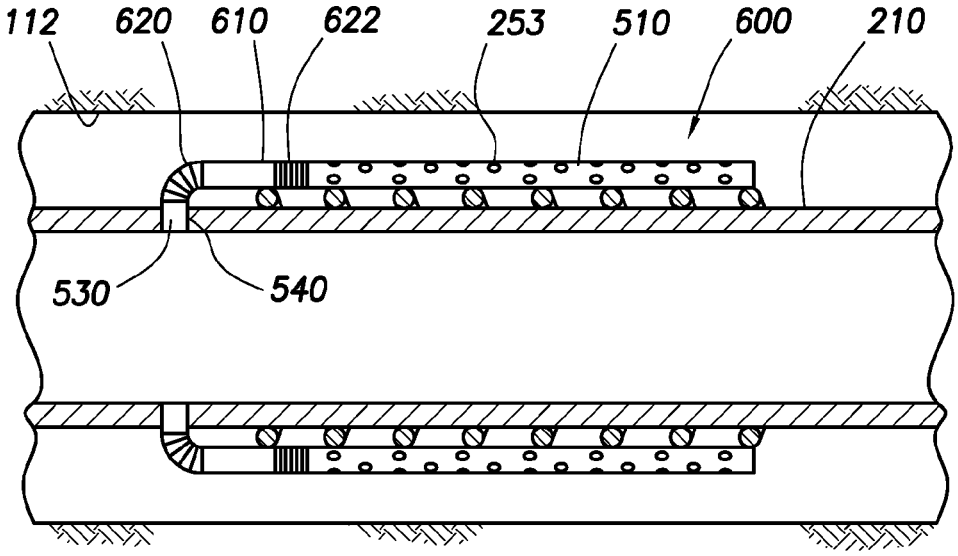
FIG. 9A is a cross sectional view of a portion of a sand control screen assembly in its first configuration according to an embodiment of the disclosure.
Figure 9B:
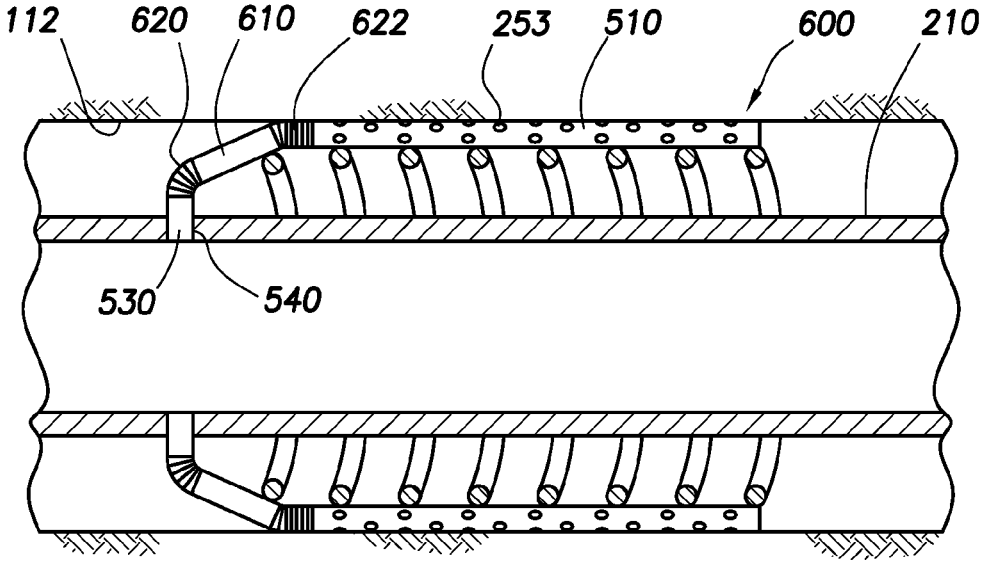
FIG. 9B is a cross sectional view of a portion of a sand control screen assembly in its second configuration according to an embodiment of the disclosure.

Even though the sand control screen assemblies 200 and 500 have been described as having fluid collection elements that extend radially outward in a piston-like manner, those skilled in the art will recognize that other techniques, which would be considered within the scope of the present invention, may be used to bias the fluid collection elements. For example, as best seen in FIG. 9A, a sand control screen assembly 600 may comprise the pipe 210 and a plurality of flexible fluid inlets 610 formed in the shape of an "L" in the running configuration. The flexible fluid inlets 610 may comprise the tubular member 510 having a plurality of the perforations 253 and the discharge tube 530 that extends radially inward from the tubular member 510 through the opening 540 of the pipe 210. A filter medium of a type discussed above may be disposed within the tubular member 510, the discharge tube 530, or both. The flexible fluid inlets 610 may also comprise a pair of flexible joints 620, and 622 configured to enhance the ability of the tubular member 510 to contact the wellbore 112 when the stored mechanical energy 256 (not shown) is released. FIG. 9B illustrates the sand control screen assembly 600 in its operating configuration.

Figure 10:
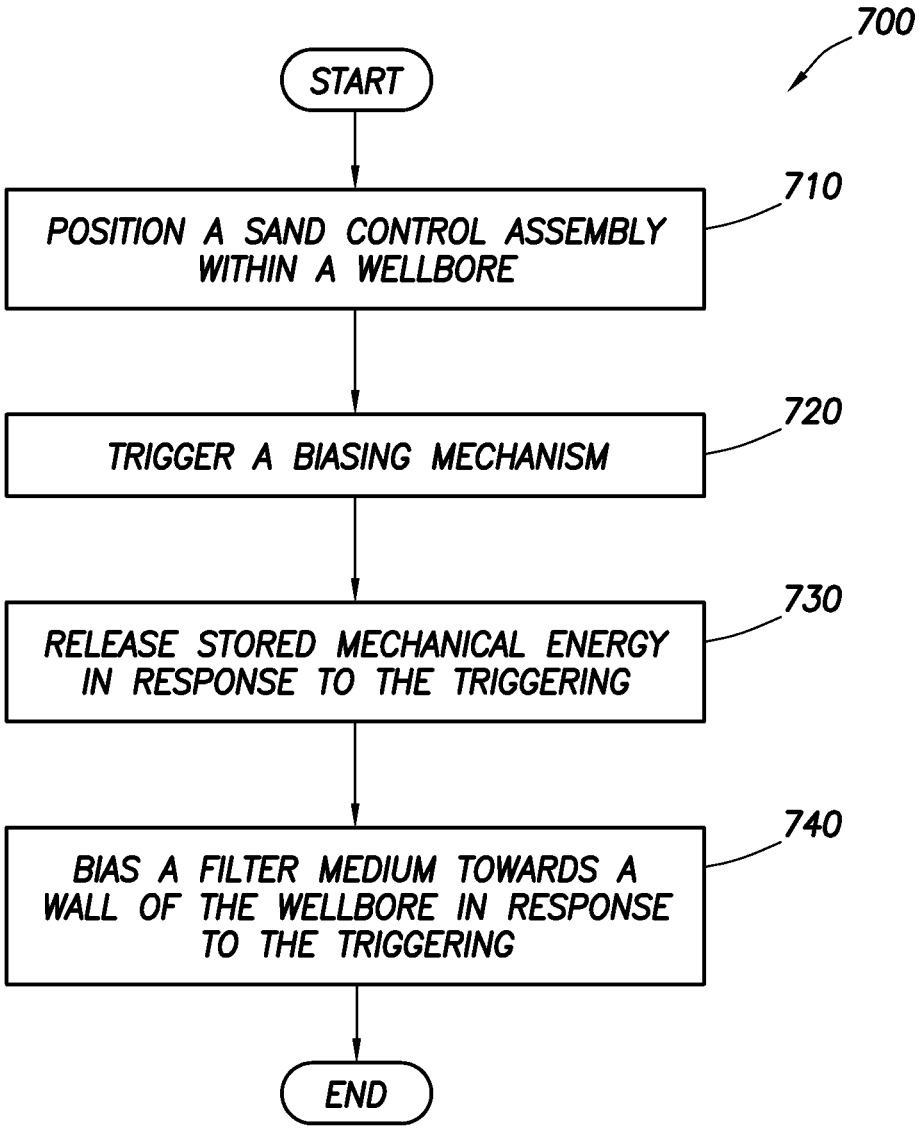
FIG. 10 is a flowchart of a method according to an embodiment of the disclosure.

Turning now to FIG. 10, a method 700 is described. At block 710, a sand control assembly is positioned in a wellbore. At block 720, a biasing mechanism is triggered. In an embodiment, the biasing mechanism may comprise one or more springs. A variety of springs may be used. Suitable springs may be a bow spring, a coiled spring, a volute spring, a gas spring, a torsion spring, or coiled memory material. Triggering the biasing mechanism may comprise degrading or removing a retention mechanism thereby allowing the biasing mechanism to deploy. The triggering may be produced by any number of stimuli. For example, the triggering may be produced by an electric stimulus, a thermal stimulus, a mechanical stimulus, a chemical stimulus or combination thereof.

At block 730, stored mechanical energy is released in response to the triggering. As described above, the biasing mechanism may be one or more springs. These springs may be configured to store mechanical energy such that when they are released they act as a biasing mechanism. The springs may be configured to store mechanical energy by being compressed and restrained by the retention mechanism. Such stored mechanical energy may then be released by the degradation or removal of the retention mechanism.

At block 740, a filter medium is biased towards a wall of the wellbore in response to the triggering. In an embodiment, the filter medium may be biased towards a wall of the wellbore by the springs released by the retention mechanism in response to any of the described stimuli. In an embodiment, the sand control screen assembly may ensure that a filter medium remains biased towards a wall of the wellbore through the use of a ratchet, an expandable plug, or combinations thereof. The biasing mechanism (e.g., a spring) may be triggered, which may comprise degrading the retaining mechanism.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A sand control screen assembly selectively positionable within a wellbore, the sand control screen assembly comprising:

a pipe comprising an internal flow path disposed therethrough;

a fluid collection subassembly disposed externally to the pipe and in fluid communication with the internal flow path, wherein the fluid collection subassembly is configured to prevent at least some particulate matter from entering the internal flow path;

a filter medium disposed in a fluid path on an exterior of the fluid collection subassembly, wherein the filter medium comprises longitudinally overlapping screen elements;

a biasing mechanism disposed between the fluid collection subassembly and the pipe, wherein the biasing mechanism is configured to bias the fluid collection subassembly towards a wall of the wellbore; and a retaining mechanism configured to release the biasing mechanism in response to a trigger, wherein the retaining mechanism comprises one or more coating layers disposed over at least a portion of a surface of the retaining mechanism, wherein the one or more coating layers are configured to isolate at least the portion of the surface of the retaining mechanism from a surrounding fluid until the one or more coating layers are removed.

2. The sand control screen assembly of claim 1, wherein the retaining mechanism comprises an acid reactive material.

3. The sand control screen assembly of claim 2, wherein the retaining mechanism comprises at least one of barium, sodium, manganese, chromium, iron, cobalt, nickel, zinc, aluminum, magnesium, calcium, tin, alloys thereof, compositions thereof, or any combination thereof.

4. The sand control screen assembly of claim 1, wherein the retaining mechanism directly engages the biasing mechanism.

5. The sand control screen assembly of claim 1, wherein the retaining mechanism engages the fluid collection subassembly, and wherein the fluid collection subassembly engages the biasing mechanism.

6. The sand control screen assembly of claim 1, wherein the retaining mechanism retains the biasing mechanism.

7. The sand control screen assembly of claim 1, wherein the biasing mechanism comprises a spring, and wherein the spring comprises a bow spring, a coiled spring, a volute spring, a gas spring, a torsion spring, a wave spring, polymeric material, or a memory material.

8. The sand control screen assembly of claim 1, further comprising a mechanism configured to maintain the fluid collection subassembly in an extended state after it has been biased towards a wall of the wellbore.

9. The sand control screen assembly of claim 8, wherein the mechanism comprises an expandable stop, a ratchet, a wedge, or any combination thereof.

10. The sand control screen assembly of claim 1, wherein the fluid collection subassembly comprises a filter medium disposed in a fluid path between an exterior of the sand control screen assembly and the internal flow path.

11. A sand control screen assembly comprising:

a pipe comprising at least one opening in a sidewall portion, and an internal flow path disposed therethrough;

a fluid collection subassembly disposed externally to the pipe and in fluid communication with the internal flow path;

a filter medium disposed in a fluid path on an exterior of the fluid collection subassembly, wherein the filter medium comprises longitudinally overlapping screen elements;

a biasing mechanism disposed between the filter medium and the pipe; and a retaining mechanism configured to release the biasing mechanism in response to a trigger, wherein the biasing mechanism is configured to bias the filter medium towards a wall of the wellbore when released.

12. The sand control screen assembly of claim 11, wherein the trigger comprises an electric stimulus, a magnetic stimulus, a thermal stimulus, a mechanical stimulus, or any combination thereof.

13. The sand control screen assembly of claim 11, wherein the trigger comprises a chemical stimulus.

14. The sand control screen assembly of claim 13, wherein the chemical stimulus is an acid, a base, an acid generating component, a base generating component, or any combination thereof.

15. The sand control screen assembly of claim 13, wherein the chemical stimulus degrades at least a portion of the retaining mechanism.

16. The sand control screen assembly of claim 11, wherein the filter medium is configured to support the walls of the wellbore.

17. The sand control screen assembly of claim 16, wherein the filter medium is configured to form a filter layer in contact with the wall of the wellbore when the biasing mechanism biases the filter medium towards the wall of the wellbore.

18. The sand control screen assembly of claim 11, further comprising a mechanism configured to maintain the filter medium in an extended state after it has been biased towards the wall of the wellbore.

19. The sand control screen assembly of claim 18, wherein the mechanism comprises an expandable stop, a ratchet, a wedge, or any combination thereof.

20. The sand control screen assembly of claim 11, wherein the biasing mechanism comprises at least one spring.

* * * * *